US007619566B2

(12) United States Patent
Kim et al.

(10) Patent No.: US 7,619,566 B2
(45) Date of Patent: Nov. 17, 2009

(54) IMPEDANCE TRANSFORMATION TYPE WIDE BAND ANTENNA

(75) Inventors: Byung-Nam Kim, Kyounggi-do (KR); Jin-Seok Kim, Kyounggi-do (KR); Seung-Yong Lee, Kyounggi-do (KR)

(73) Assignee: Ace Antenna Corp., Incheon-Shi (KR)

( * ) Notice: Subject to any disclaimer, the term of this patent is extended or adjusted under 35 U.S.C. 154(b) by 62 days.

(21) Appl. No.: 11/551,398

(22) Filed: Oct. 20, 2006

(65) Prior Publication Data

US 2007/0091000 A1 Apr. 26, 2007

(30) Foreign Application Priority Data

Oct. 20, 2005 (KR) ..... 10-2005-0099343

(51) Int. Cl.
*H01Q 1/38* (2006.01)
*H01Q 1/50* (2006.01)

(52) U.S. Cl. ..... 343/700 MS; 343/860

(58) Field of Classification Search ..... 343/700 MS, 343/702, 767, 850, 852, 860, 863
See application file for complete search history.

(56) References Cited

U.S. PATENT DOCUMENTS 6,980,157 B2 * 12/2005 Nevermann ..... 343/702
7,102,573 B2 * 9/2006 Morrow et al. ..... 343/700 MS
7,154,443 B2 * 12/2006 Inaba et al. ..... 343/702
2003/0080905 A1 * 5/2003 Lin et al. ..... 343/702
2004/0201530 A1 * 10/2004 Wen et al. ..... 343/725

FOREIGN PATENT DOCUMENTS

EP 0867967 A2 9/1998
EP 0892459 A1 1/1999
WO 2004/054034 6/2004

* cited by examiner

*Primary Examiner*—Hoang V Nguyen
*Assistant Examiner*—Robert Karacsony

(57) ABSTRACT

The present invention relates to an impedance transformation-type wide band internal antenna. The wide band antenna includes a radiation part, a short circuit part, a feeding part, and a feeding pin. The radiation part is formed to have a predetermined length and width according to an operating frequency, the radiation part including a plurality of stubs formed in arbitrary shapes according to location of a plurality of slots. The short circuit part causes part of a side surface of the radiation part to be connected to an external ground. The feeding part is extended from the stubs, formed on the side surface of the radiation part to be adjacent to the short circuit part, and is bent multiple times, the feeding part being formed on a bottom surface of the radiation part to have a predetermined length and width. The feeding pin is formed on an end of the feeding part and is fed with current. Accordingly, the present invention is advantageous in that impedances are matched using the length and interval of the feeding part, which is bent multiple times, and the size of a through hole formed in the feeding part, so that a plurality of wide band resonant frequencies is formed, thus enabling the wide band antenna to be simultaneously used for different frequency bands in a wireless communication system that uses different frequency bands.

5 Claims, 5 Drawing Sheets

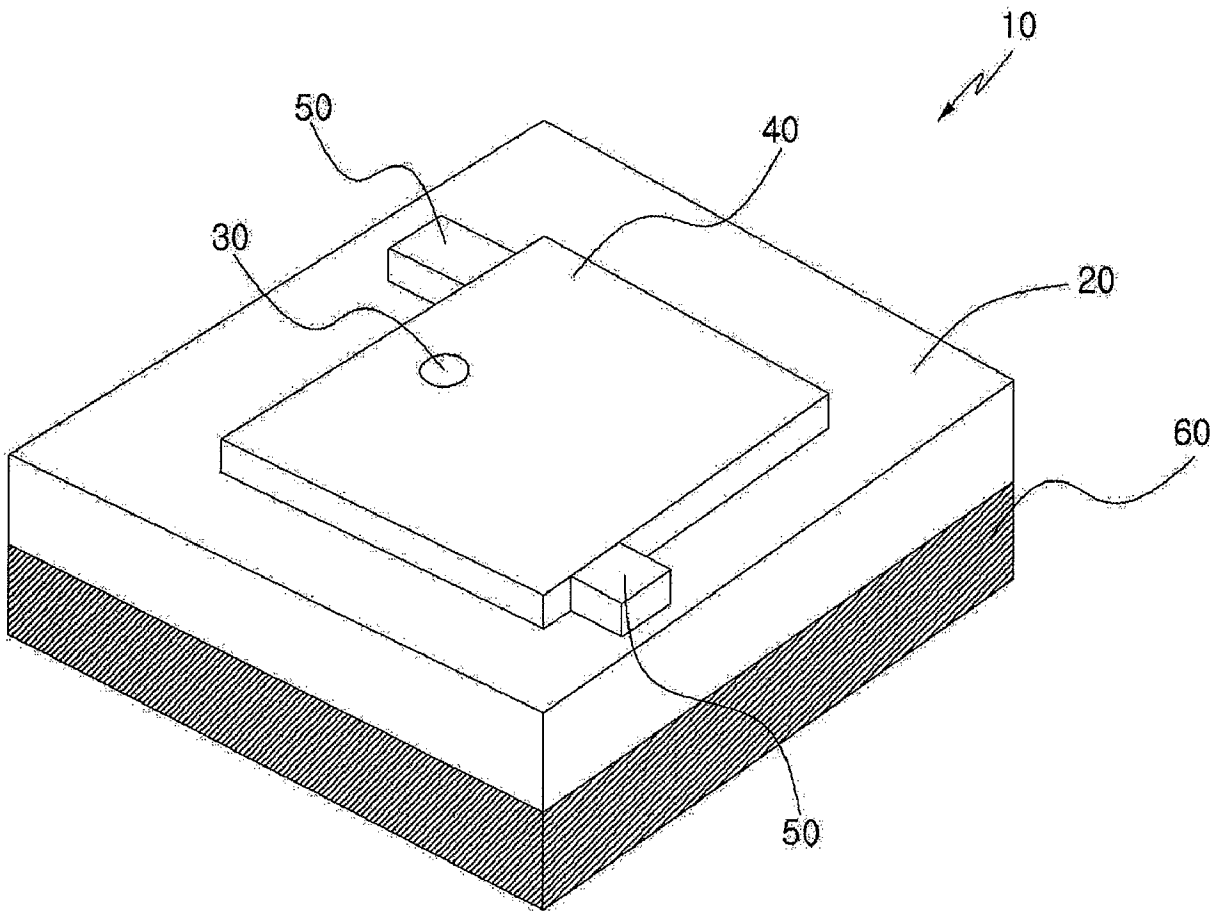
[FIG. 1A]
Related Art

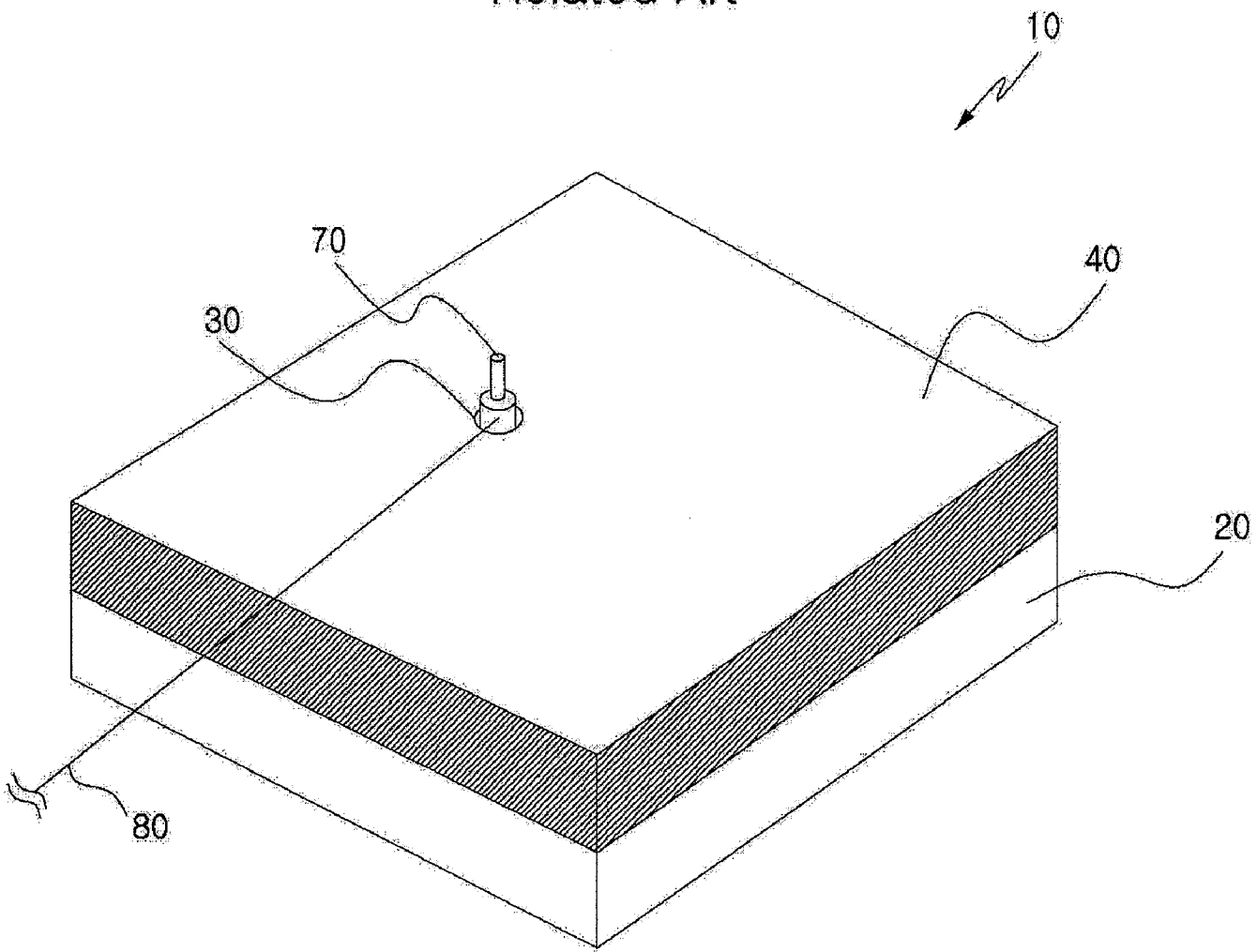
[FIG. 1B]
Related Art

[FIG. 2B]
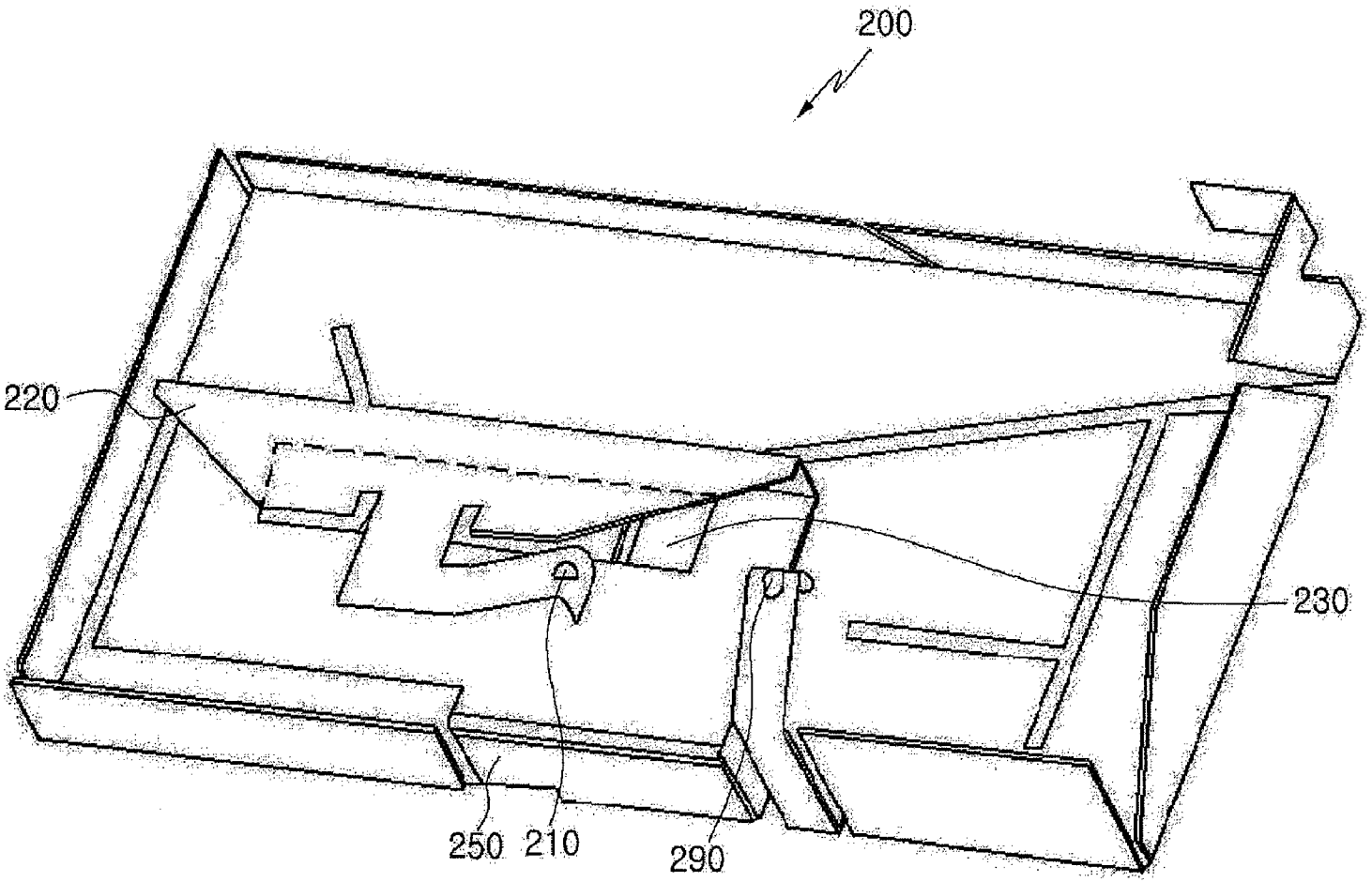

IMPEDANCE TRANSFORMATION TYPE WIDE BAND ANTENNA

BACKGROUND OF THE INVENTION

1. Field of the Invention

The present invention relates, in general, to an impedance transformation-type wide band internal antenna and, more particularly, to an impedance transformation-type wide band antenna, in which a feeding part is formed in a multi-path structure to transform impedance, and is bent multiple times to generate a plurality of resonant frequencies, thus enabling the impedance transformation-type wide band antenna to be used both in a multiple band and in a wide band.

2. Description of the Related Art

Currently, services for wireless communication have changed from narrow band communication services to wide band communication services, such as the Internet or multimedia. Further, due to the need to develop an integrated system capable of providing multiple services through a single terminal, the antennas of wireless communication systems are required to have wide band characteristics together with integrated functions.

FIG. 1A is a perspective view showing a conventional single layer wide band antenna using stubs, and FIG. 1B is a bottom view of the wide band antenna of FIG. 1A.

As shown in FIG. 1A, a conventional antenna 10 includes a dielectric (substrate) 20 provided on the upper portion thereof, a patch 40 formed on the dielectric 20 to have a width less than that of the dielectric 20 and to have a hole 30 formed therein, thin plate-shaped conductive stubs 50 attached to the diagonal corners of the patch 40 and operated to transform the resonant frequency and impedance of the antenna 10 by converting the location and size of the conductive stubs 50, and a conductive ground plane 60 attached to the bottom surface of the dielectric 20.

As shown in FIG. 1B, the antenna 10 includes a coaxial cable 80 that is soldered with a feeding point 70 through a hole 30 formed in the patch 40 and is operated to provide an external signal source to the patch 40.

The patch 40 having a predetermined size is constructed in such a way that a first stub 51, attached to the upper left portion of the patch 40, and a second stub 52, attached to the lower right portion of the patch 40, are integrated with the patch 40. In this case, wide band characteristics can be realized only when the locations of the stubs 51 and 52 are designed so as to be exactly symmetrical around the center of the patch 40. If the stubs 51 and 52 are installed to be opposite each other, wide band characteristics cannot be realized in the antenna 10, and thus the stubs 51 and 52 are placed to be approximately symmetrical with each other around the center of the patch 40.

Meanwhile, the dielectric 20, disposed between the ground plane 60 and the patch 40, which is a radiation element, can be filled with an air layer according to the purpose of the antenna 10. A connector required to feed the antenna 10 is also placed to be spaced apart from the center of the antenna 10 by a predetermined distance in the direction of one side thereof, so that the impedance of the antenna can be adjusted using the location of the feeding point 70, together with the sizes of the stubs 51 and 52, thus obtaining wide band characteristics through impedance matching.

The conventional single layer wide band antenna using stubs is problematic in that, since the sizes of stubs or the location of a feeding point are changed so as to adjust the impedance thereof, there is a limitation in the space in which the antenna can actually be mounted in a wireless communication terminal, and since a multiple band must also be supported in the same antenna space, it is difficult to utilize such an antenna for a wireless communication system.

SUMMARY OF THE INVENTION

Accordingly, the present invention has been made keeping in mind the above problems occurring in the prior art, and an object of the present invention is to provide an impedance transformation-type wide band antenna, which is beneficial for the miniaturization of the main body thereof.

Another object of the present invention is to provide an impedance transformation-type wide band antenna, in which a feeding part, formed in a multi-path structure, is bent multiple times, so that the height and length of the feeding part and the size of a through hole formed in the multi-path structure are adjusted to generate a plurality of resonant frequencies, thus enabling the antenna to be used both in a multiple band and in a wide band.

In order to accomplish the above objects, the present invention provides an impedance transformation-type wide band antenna, comprising a radiation part formed to have a predetermined length and width according to an operating frequency, the radiation part including a plurality of stubs formed in arbitrary shapes according to location of a plurality of slots, a short circuit part for causing part of a side surface of the radiation part to be connected to an external ground (PCB ground), a feeding part extended from the stubs, formed on the side surface of the radiation part to be adjacent to the short circuit part, and bent multiple times, the feeding part being formed on a bottom surface of the radiation part to have a predetermined length and width, and a feeding pin formed on an end of the feeding part and fed with current.

Preferably, the feeding part may be designed so that impedances are matched using a length and interval of the feeding part, which is bent multiple times.

Preferably, the feeding part may be formed to be bent in any one of a sideways u-shape or a backwards s-shape.

Preferably, the feeding part may have a through hole formed therein.

BRIEF DESCRIPTION OF THE DRAWINGS

The above and other objects, features and other advantages of the present invention will be more clearly understood from the following detailed description taken in conjunction with the accompanying drawings, in which:

FIG. 1A is a perspective view showing a conventional single layer wide band antenna using stubs;

FIG. 1B is a bottom view showing the wide band antenna of FIG. 1A;

FIG. 2B is a perspective view showing the bottom surface of the impedance transformation-type wide band antenna according to an embodiment of the present invention.

DESCRIPTION OF THE PREFERRED EMBODIMENTS

Figure 2A:
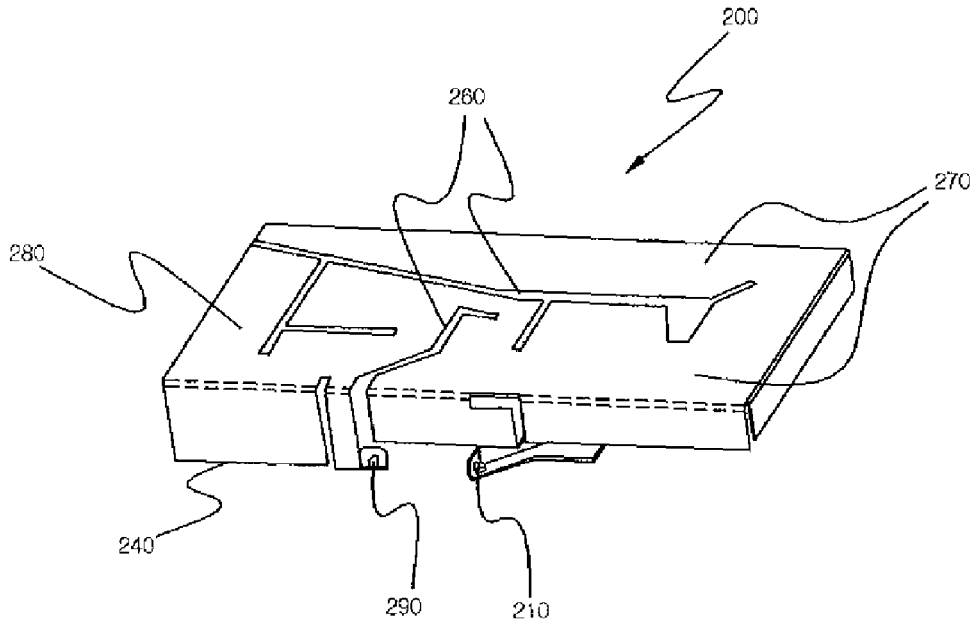
FIG. 2A is a perspective view showing the top surface of an impedance transformation-type wide band antenna according to an embodiment of the present invention.

Hereinafter, embodiments of the present invention will be described in detail with reference to the attached drawings.

Reference now should be made to the drawings, in which the same reference numerals are used throughout the different drawings to designate the same or similar components.

FIG. 2A is a perspective view showing the top surface of an impedance transformation-type wide band antenna according to an embodiment of the present invention, and FIG. 2B is a perspective view showing the bottom surface of the impedance transformation-type wide band antenna according to an embodiment of the present invention.

As shown in FIGS. 2A and 2B, a radiation part 240 is made of a metallic plate formed in the shape of a rectangular parallelepiped, and part of one side surface extends, and thus a feeding part 220 and a short circuit part 290 are formed on the bottom surface of the radiation part 240.

Stubs 250, defined by a plurality of slots 260 formed in the top surface and side surfaces of the radiation part 240 in the shape of a meandering line, are formed both on the top surface and side surfaces of the radiation part 240 to have a predetermined length, and are terminated with one ends thereof opened. The stubs 250 are divided into arbitrary shapes by the slots 260, and include a first stub 270 and a second stub 280.

The short circuit part 290 is formed on the one side surface of the radiation part 240, adjacent to the feeding part 220, to cause part of the short circuit part 290 to be connected to an external ground.

The feeding part 220 is adjacent to the short circuit part 290, and is formed to extend from the stubs 250 formed on the side surface of the radiation part 240 and to be bent multiple times in a "ㄷ"-shape, and to have a through hole 230 formed therein, thus a multi-path structure is implemented. Further, the feeding part 220 can be formed in a "ㄹ"-shape or various shapes within the height limitation.

The feeding pin 210 is formed on the end of the feeding part 220 in the shape of a rectangle having a predetermined width.

The impedance transformation-type wide band antenna 200 is fed with current through the feeding pin 210 formed in the shape of a rectangle having a predetermined width. The current is adjusted using an inductance component corresponding to the length of the feeding part 220, which is bent multiple times in a "ㄷ" shape and which is formed on part of the one side surface of the radiation part 240 made of a metallic plate having the shape of a rectangular parallelepiped, and the interval of the feeding part 220, and thus the capacitance component and inductance component are formed. Accordingly, the multi-path structure changes the flow of current through the through hole formed in the feeding part 220, thus forming inductance component. The flow of current is adjusted using the size of the through hole 230.

Further, the short circuit part 290 is connected to the external ground, and thus components thereof are formed according to the vertical distance between the short circuit part 290 and the radiation part 240, and the area of the feeding part 220. Impedances are matched using the capacitance component and the inductance component, so that a plurality of wide band high resonant frequencies is generated. Through the feeding part 220 in which impedances are matched, dual-band resonant frequencies are generated using the lengths of the first and second stubs 270 and 280, which are defined by the plurality of slots 260, formed on the top and side surfaces of the radiation part 240, and which are formed on the top and side surfaces of the radiation part 240 to have predetermined lengths and are terminated with one ends thereof opened.

Figure 3:
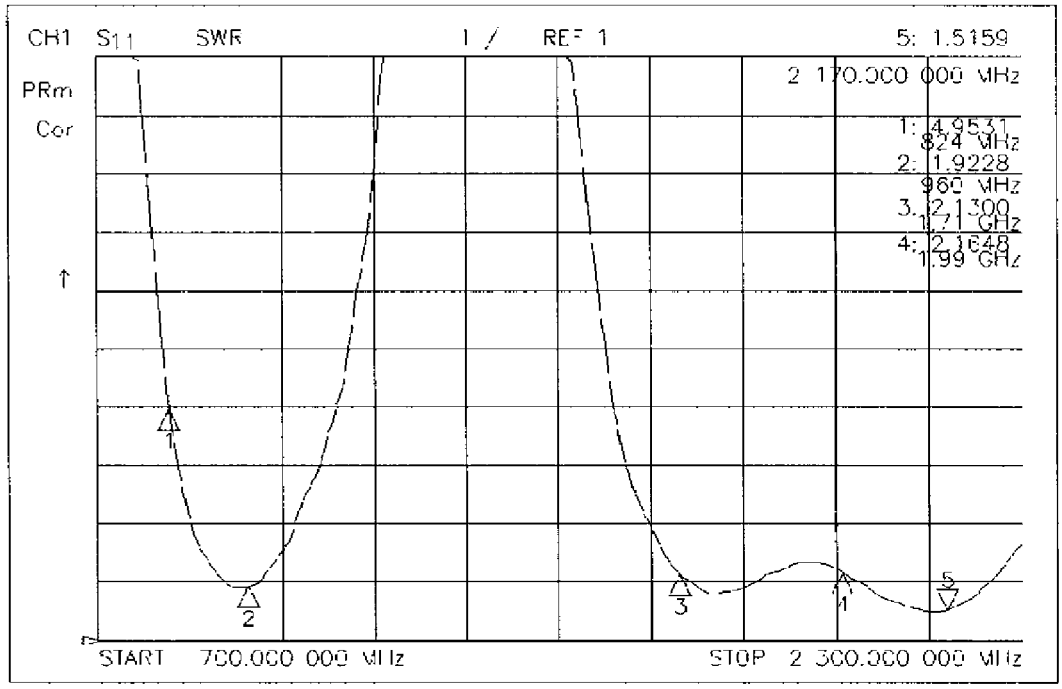
FIG. 3 is a graph showing the characteristics of the antenna of FIG. 2.

FIG. 3 is a graph showing the characteristics of the antenna of FIGS. 2A and 2B.

As shown in FIG. 3, reflection characteristics for frequencies ranging from 700 MHz to 2300 MHz were measured for the antenna 200 of FIG. 2. The graph illustrates Standing Wave Ratio (SWR) characteristics of the antenna 200, and shows wide band characteristics.

A frequency band for cellular communication which is currently commercialized is a band ranging from 800 MHz to 900 MHz, and a frequency band for Personal Communication Services (PCS) is a band ranging from 1700 MHz to 1900 MHz. A frequency band for International Mobile Telecommunications-2000 (IMT-2000) is a band ranging from 1900 MHz to 2200 MHz. For an actual usage band for IMT-2000, a band of 230 MHz is assigned, and IMT-2000 must be operated in a wide band. If such characteristics are compared to those of the antenna 200 of the present invention, it can be seen that the wide band characteristics of the antenna are sufficiently learned, and the antenna of the present invention is utilized for a dual band or multiple band.

That is, the antenna of the present invention not only can cover respective bands, but also can be simultaneously used for different frequency bands, as a single antenna, in a wireless communication system that uses different frequency bands.

As described above, the present invention provides an impedance transformation-type wide band antenna, which matches impedances using the length and interval of a feeding part, which is formed in a multi-path structure and is bent multiple times, the vertical distance between a short circuit part connected to an external ground and a radiation part, and the size of a through hole formed in the feeding part, so that a plurality of wide band resonant frequencies is formed, thus enabling the wide band antenna to be simultaneously used for different frequency bands, as a single antenna, in a wireless communication system that uses different frequency bands.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An impedance transformation-type wide band antenna, comprising:

a radiation part having a predetermined length and width according to an operating frequency and including a plurality of stubs formed in an arbitrary shape based on the location of a plurality of slots formed in a top surface and side surfaces of the radiation part;

a short circuit part for causing part of a side surface of the radiation part to be connected to an external printed circuit board (PCB) ground;

a feeding part having a multi-path structure extended from one side of the top surface of the radiation part formed by bending a plate multiple times according to a predetermined length and width associated with a size of a through hole formed in the multi-path structure, wherein the plate of the feeding part extended from the one side of the top surface of the radiation part is bent in a "U" or "S" shape to form multiple layers having at least one bent surface and an opening portion formed inside of the "U" or "S" shaped bent surfaces that are facing against each other; and wherein a plurality of resonant frequencies can be generated by a combination of bending the feeding part and the size of the hole; and a feeding pin formed on an end of the feeding part configured to be fed with an electric current.

2. The impedance transformation-type wide band antenna according to claim 1, further comprising:

a parasitic inductance formed on an entire length and an area of the feeding part and a capacitive capacitance formed on an interval between the multiple layers by bending the feeding part of the multi-path structure to make broadband impedance matching, wherein a flow of the electric current is adjusted by the size of the through hole.

3. The impedance transformation-type wide band antenna according to claim 1, wherein the feeding part is configured to be bent having at least one of a bent surfaces and an opening portion formed inside of the "U"-shape or the "S"-shape, wherein the opening portion is configured to hold or store an electrical charge and the bent surfaces where the current flows through the surfaces that induces an electromagnetic field.

4. The impedance transformation-type wide band antenna according to claim 1, wherein the radiation part is designed so that impedances are matched using a capacitance and an inductance to generate a plurality of wide band resonant frequencies.

5. The impedance transformation-type wide band antenna according to claim 1, wherein the radiation part comprises a first stub configured to generate low resonant frequencies and a second stub configured to generate high resonant frequencies according to a terminated length of the stubs.

* * * * *